US005815987A

United States Patent [19]

Beasley

[11] Patent Number: 5,815,987

[45] Date of Patent: Oct. 6, 1998

[54] TURNTABLE WITH ACOUSTIC DOOR AND WALL PANEL

[76] Inventor: Rex W. Beasley, 1001 Main St., Venice, Calif. 90291

[21] Appl. No.: 696,322

[22] Filed: Aug. 13, 1996

[51] Int. Cl.[6] ..... E04B 1/396

[52] U.S. Cl. ..... 52/65; 104/4; 104/35; 104/46; 108/22; 248/349

[58] Field of Search ..... 52/64, 65, 241, 52/242; 472/29, 35; 248/349; 104/35, 44, 46, 99

[56] References Cited

U.S. PATENT DOCUMENTS

| | | | |
|---|---|---|---|
| 2,764,783 | 10/1956 | Teller . | |
| 2,823,425 | 2/1958 | Granek . | |
| 3,078,522 | 2/1963 | Anderson . | |
| 3,125,189 | 3/1964 | Graham . | |
| 3,383,810 | 5/1968 | Mola . | |
| 3,388,513 | 6/1968 | Bauer . | |
| 3,395,500 | 8/1968 | Smith . | |
| 3,399,501 | 9/1968 | Rossman . | |
| 3,491,496 | 1/1970 | Johnston . | |
| 3,696,805 | 10/1972 | Sweeten et al. . | |
| 3,933,400 | 1/1976 | Helgeson . | |
| 4,191,437 | 3/1980 | Funke | 312/305 |
| 4,263,761 | 4/1981 | Kristoff | 52/64 X |
| 4,569,164 | 2/1986 | Dickson | 52/64 |
| 4,763,714 | 8/1988 | Williams | 52/64 X |
| 5,125,203 | 6/1992 | Daw | 52/241 |
| 5,400,550 | 3/1995 | Beasley | 52/65 |
| 5,471,791 | 12/1995 | Keller | 52/64 X |

*Primary Examiner*—Beth A. Aubrey
*Attorney, Agent, or Firm*—Kelly Bauersfeld Lowry & Kelley, LLP

[57] ABSTRACT

A rotary turntable for use in a building, such as in a residential or office environment, includes at least one door and at least one wall panel for cooperating with adjacent stationary building structures such as walls and a ceiling to define a variable floor plan. The turntable door and wall panel include expansion members for engaging and contacting adjacent building structures to provide an acoustic barrier between rooms. In the preferred form, the turntable door is powered for driven movement between open and closed positions which can vary according to the specific rotational position of the turntable.

36 Claims, 5 Drawing Sheets

FIG. 1
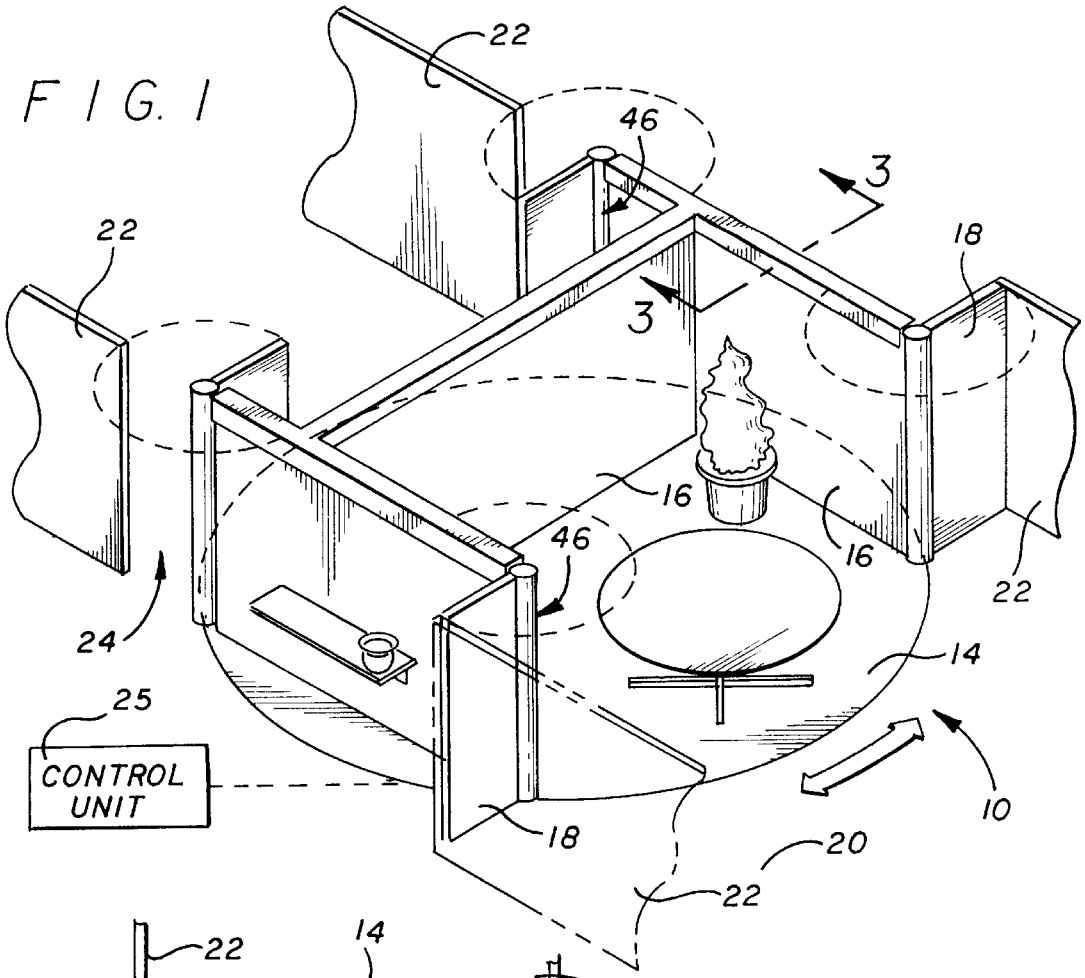
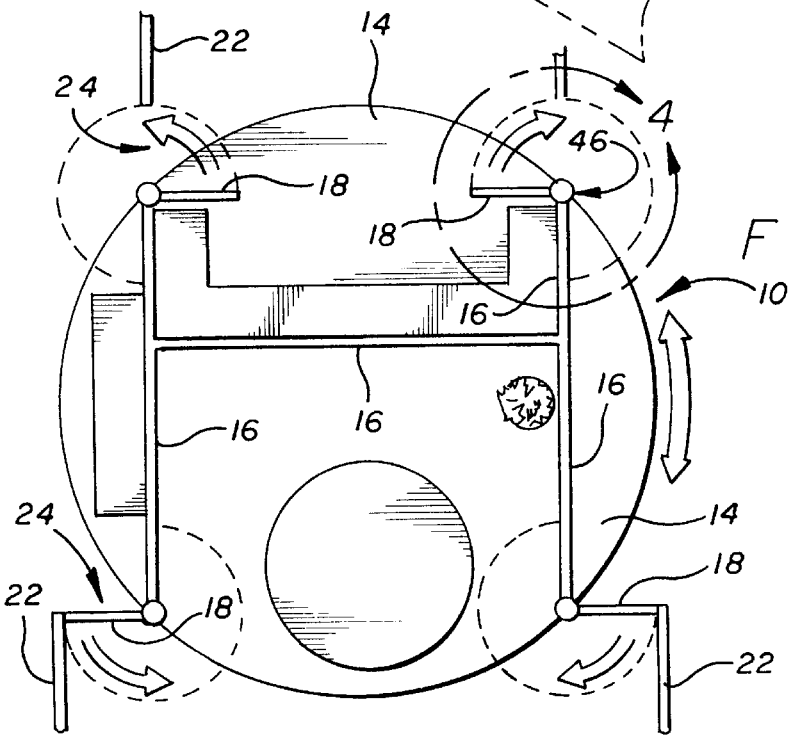
FIG. 2

FIG. 3
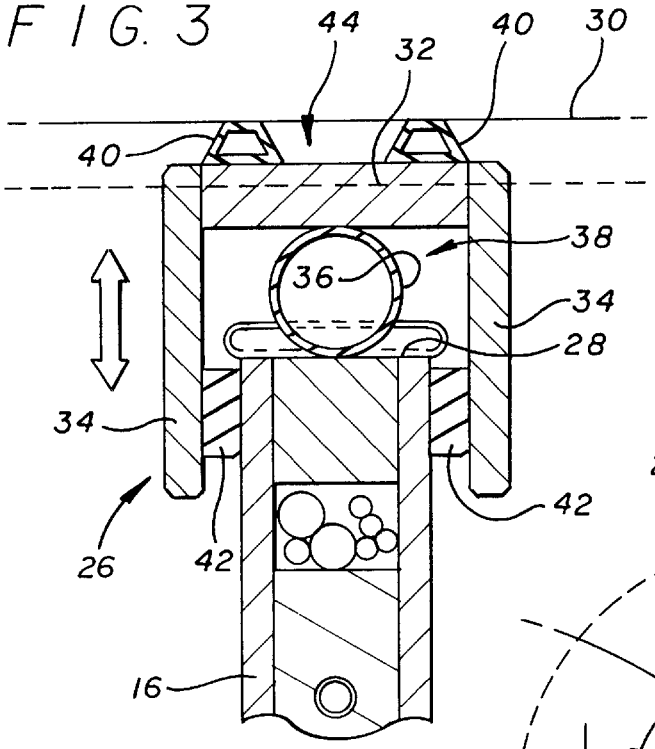
FIG. 4
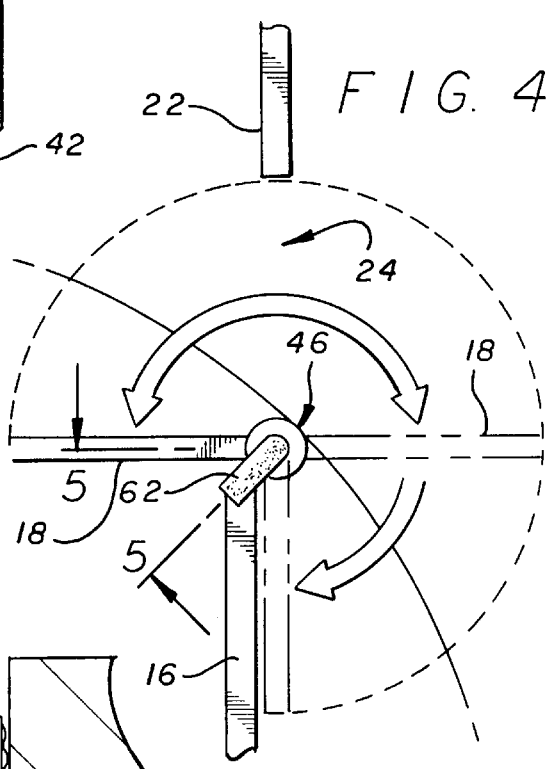
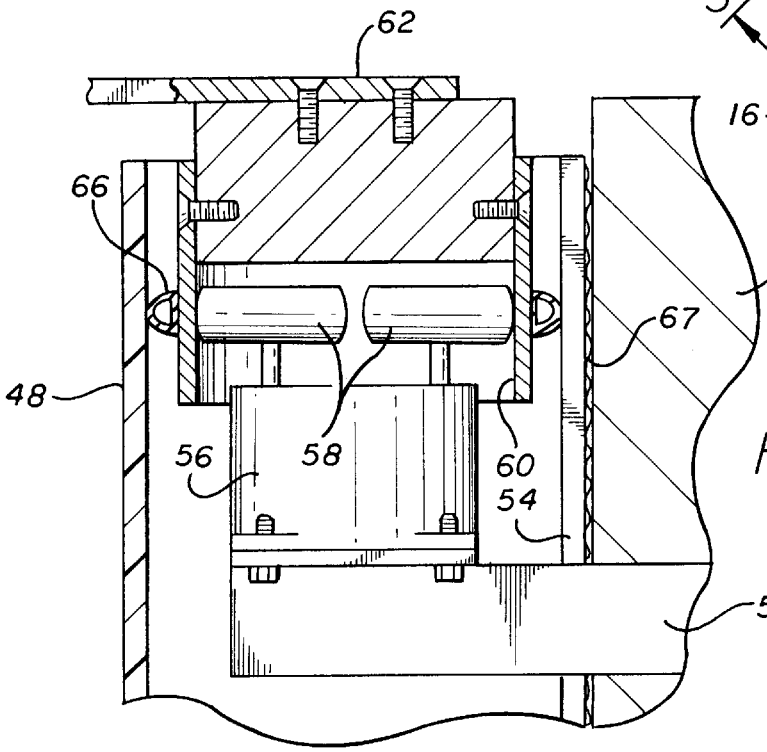
FIG. 5

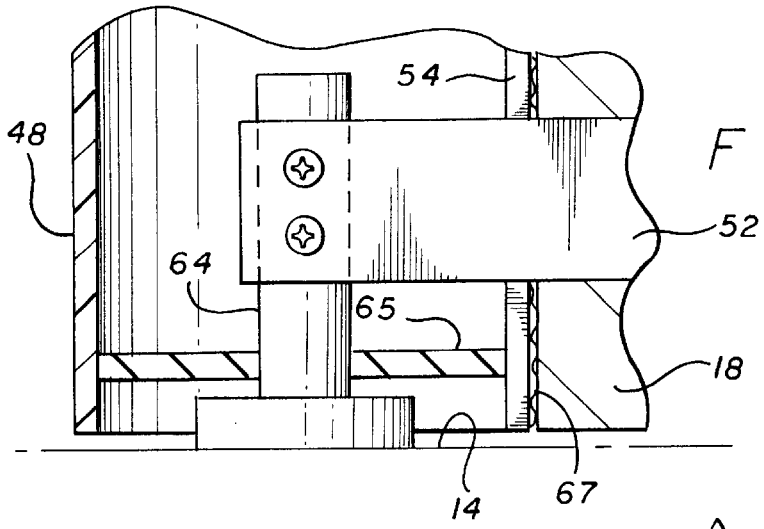
FIG. 6
FIG. 7
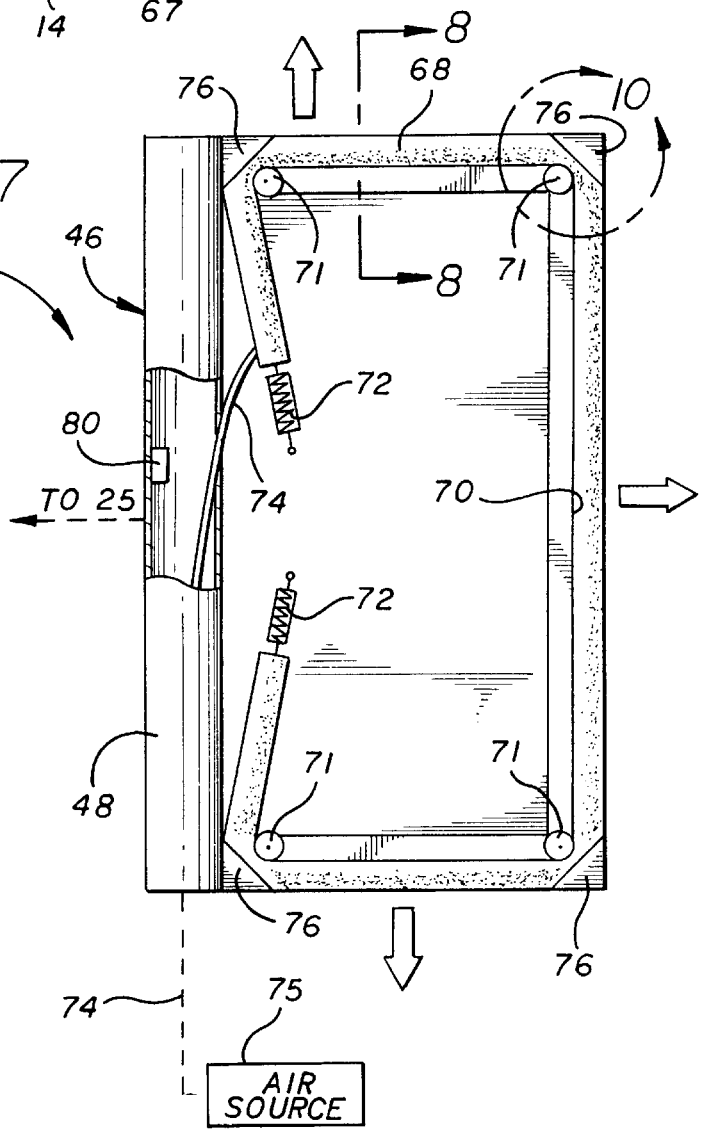
FIG. 8
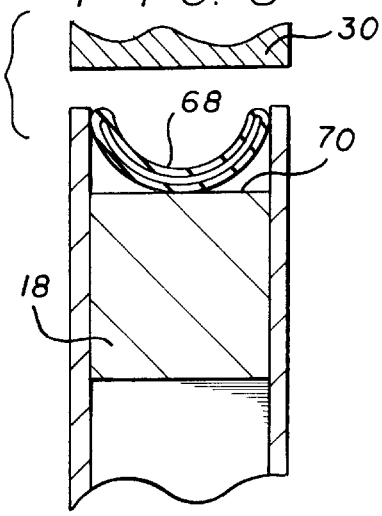

FIG. 9
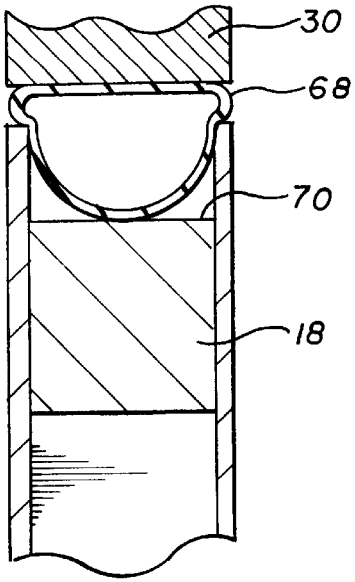
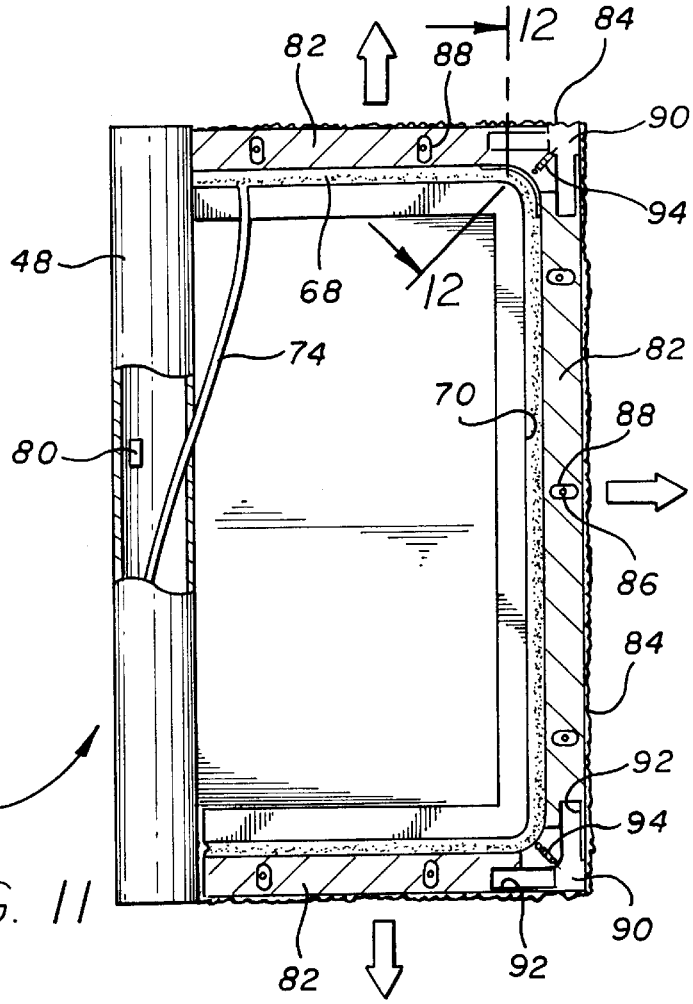
FIG. 11
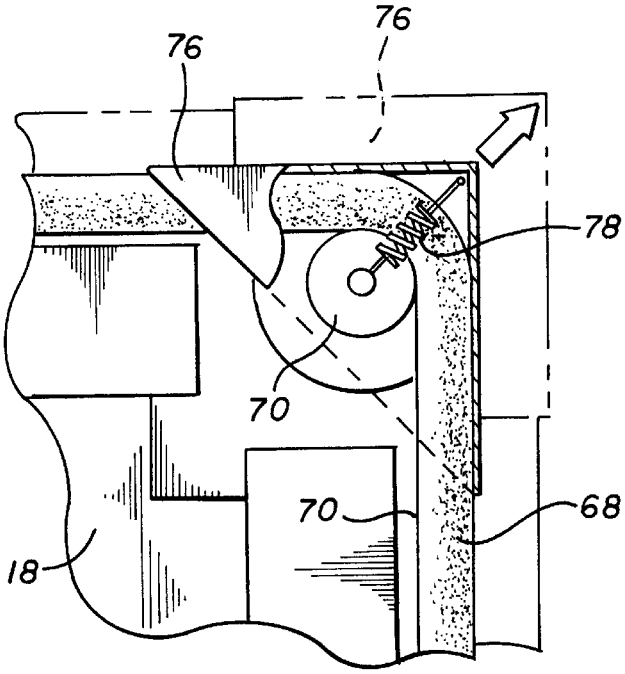
FIG. 10

TURNTABLE WITH ACOUSTIC DOOR AND WALL PANEL

BACKGROUND OF THE INVENTION

This invention relates generally to rotary turntables of a type adapted for installation into a building structure to provide a rotatable floor surface, in combination with related wall panels and/or doors for cooperating with the adjacent stationary building structure to provide a variable floor plan. More specifically, this invention relates to an improved turntable having at least one door and at least one related wall panel with means for providing an effective acoustic barrier between adjacent rooms.

Turntables are generally known in the art for installation into a building, such as a residential or commercial structure, to provide a rotatable floor surface or platform in combination with movable walls and/or door structures to achieve a variable floor plan. Such turntables mount the circular floor platform on suitable bearings and/or rollers for turning movement, typically in response to operation of an associated drive means. Wall panels on the rotatable floor platform are adapted to cooperate with adjacent stationary building structures such as fixed walls and a ceiling to produce a floor plan which can be altered quickly and easily by rotating the turntable to one of several different rotational positions within the building. Rotary turntables of this general type are shown and described in U.S. Pat. No. 5,400,550 and U.S. Ser. No. 08/055,382, which are incorporated by reference herein.

Rotary turntables in a typical residential or office setting offer potentially significant benefits with regard to efficient use of available floor space. In particular, the size and shape of a room can be altered quickly and easily, merely by rotating the turntable to an alternative rotational position, to adapt a room for multipurpose uses. As one example, in an office configuration, several relatively small and/or space-efficient offices can be located about the periphery of a rotary turntable, with any one of these offices being temporarily expandable in size to include a conference area by rotating the turntable to a position aligning an open-sided conference area on the turntable with a selected office. Numerous alternative adaptations of room size and shape and functional uses are available in accordance with the geometry of door and wall panel structures on the turntable.

In the past, one disadvantage associated with rotatable turntables for achieving variable floor plan in a building has involved the provision of an adequate acoustic or soundproof barrier between adjacent rooms, for different positions of turntable rotation. That is, conventional building construction techniques inherently result in at least some gaps or spaces between movable structures of the turntable and adjacent stationary structures of the building, to correspondingly result in undesirable and potentially annoying sound transmission from one room to another.

The present invention addresses the problems and disadvantages encountered in the prior art by providing an improved turntable with door and wall panel structures constructed to include an effective acoustic barrier between rooms.

SUMMARY OF THE INVENTION

In accordance with the invention, an improved rotary turntable is provided for installation into a building, particularly such as in a residential or office environment, to provide a convenient and multipurpose rotatable floor structure or platform. The turntable incorporates at least one upstanding wall panel and, in the preferred form, at least one door for cooperating with adjacent stationary building structures to define a variable floor plan according to the rotational position of the turntable. The wall panel and door include expansion members for engaging adjacent stationary building structures to provide an effective acoustic barrier between rooms.

In the preferred form, the wall panel on the turntable has an upper edge spaced a short distance below the ceiling of the stationary building structure. The expansion member on the turntable wall panel comprises a track assembly mounted along the upper edge of the wall panel for movement between a raised position with one or more resilient seal strips engaging the building ceiling, and a lowered position with the seal strips spaced below the ceiling. A pneumatic actuator operated by a control unit is provided for moving the track assembly on the wall panel between the raised and lowered positions. The track assembly is moved to the lowered position during turntable rotation to an alternative floor plan position, whereupon the track assembly is then moved to the raised position to provide an effective acoustic barrier between adjacent rooms.

At least one door is provided on the turntable in accordance with one preferred form of the invention, to selectively open and close a doorway defined between the turntable wall panel and an adjacent stationary wall of the building structure. The door is hinged along one side edge, preferably to the turntable wall panel. The expansion member on the door includes expansion seal segments mounted along the top, bottom, and outboard side edges of the door to engage adjacent structures and define an acoustic barrier when the door is closed. In the preferred form, the expansion seal segments along the door edges are displaced by a pneumatic actuator between retracted positions when the door is opened and advanced positions when the door is closed. The pneumatic actuator which operates the expansion segments on the door is desirably controlled by the same control unit that operates the pneumatic actuator for the wall panel.

In accordance with further aspects of a preferred form of the invention, the turntable door is power driven for movement between open and closed positions relative to an associated stationary building wall, in accordance with the specific rotational position of the turntable. The control unit opens the door each time the turntable is rotated to an alternative floor plan position. An impact sensor is provided as a safety device to interrupt turntable rotation, upon door impact with an object. The same impact sensor can be used to open the door automatically, for example, in response to knocking, when the turntable is in a selected floor plan position relative to the building structure.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a fragmented and somewhat schematic perspective view illustrating a turntable with acoustic doors and wall panels, embodying the novel features of the invention;

FIG. 2 is a top plan view of the turntable shown in FIG. 1, illustrated in somewhat schematic form;

FIG. 3 is an enlarged fragmented vertical sectional view taken generally on the line 3—3 of FIG. 1;

FIG. 4 is an enlarged fragmented top plan view corresponding generally with the encircled region 4 of FIG. 2;

FIG. 5 is an enlarged fragmented vertical sectional view taken generally on the line 5—5 of FIG. 4, and depicting hinged connection of the top of a door to a turntable wall panel;

FIG. 6 is an enlarged fragmented sectional view depicting hinged connection of the bottom of the door of FIG. 5 to the adjacent wall panel;

FIG. 7 is a fragmented vertical sectional view illustrating internal construction details of the door, in accordance with one preferred form of the invention;

FIG. 8 is an enlarged fragmented vertical sectional view taken generally on the line 8—8 of FIG. 7, and depicting a pneumatic actuator in a retracted position;

FIG. 9 is an enlarged fragmented vertical sectional view corresponding to FIG. 8, but depicting the pneumatic actuator in an advanced or expanded position;

FIG. 10 is an enlarged fragmented vertical sectional view corresponding generally with the encircled region 10 of FIG. 7, and illustrating a corner bracket forming a portion of the door;

FIG. 11 is a fragmented vertical sectional view depicting internal construction details of a door, formed in accordance with an alternative preferred form of the invention;

DETAILED DESCRIPTION OF THE PREFERRED EMBODIMENTS

Figure 13:
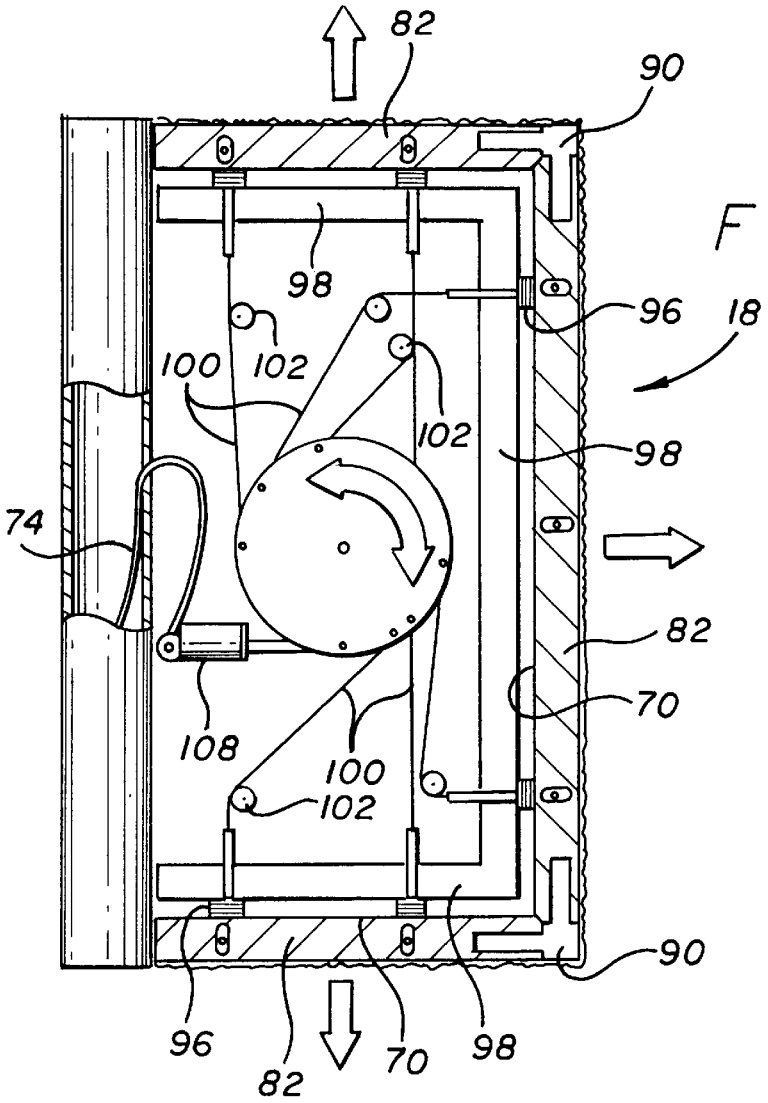
FIG. 13 is a fragmented vertical sectional view depicting internal construction details of a further alternative door configuration.

As shown in the exemplary drawings, a turntable referred to generally in FIG. 1 by the reference numeral 10 is provided for installation into a building, such as in a residential or office environment as shown. The turntable 10 comprises a rotatable floor structure or platform 14 which supports at least one upstanding wall panel 16 in combination with at least one door 18, with multiple adjoining wall panels 16 and multiple doors 18 being shown. The turntable 10 is rotatable to a selected one of several different rotational positions, with the wall panels 16 and doors 18 thereon associated in different ways with surrounding stationary building structures to provide a variable floor plan. The wall panels 16 and doors 18 include expansion members for engaging adjacent stationary building structures in the various rotational turntable positions, in order to provide an effective sound barrier between adjacent rooms.

The rotary turntable 10 is shown in somewhat schematic form in FIGS. 1 and 2, with the rotatable floor platform 14 having a generally circular shape recessed in a flush-mounted position within a surrounding floor surface 20 of the stationary building structure. While the turntable 10 may be constructed in various forms, preferred turntable configurations include relatively lightweight and modular devices as shown and described in U.S. Pat. No. 5,400,550 and U.S. Ser. No. 08/055,382, which are incorporated by reference herein. The turntable 10 is rotatable, preferably in response to power drive means (not shown) to orient the wall panels 16 and associated doors 18 in one of several different positions relative to stationary or fixed walls 22 of the building structure. These building walls 22 terminate a fixed distance from the periphery of the turntable 10 whereby they cooperate with the turntable wall panels 16 to define doorways 24 which can be selectively opened and closed by the doors 18, as will be described in more detail.

In general terms, the expansion members provided on the turntable wall panels 16 and doors 18 are designed to retract so as to permit turntable rotation from one floor plan position to another without interference with stationary building structures, and to advance when the turntable is set in a desired floor plan position so as to provide an effective acoustic or soundproof barrier between adjacent rooms. The expansion members associated with each turntable door 18 are also designed to retract and advance respectively when the door is opened and closed with the turntable set in a desired floor plan position. Turntable operation including rotary movement as well as retraction and advancement of the wall panel and door expansion members is controlled and coordinated by a main control unit 25 (FIG. 1). This control unit 25 can be suitably designed and programmed for each unique turntable design configuration, for example, specific multiple set positions for different floor plan geometries, different wall panel and door layouts, etc.

More specifically, as shown best in FIG. 3, the expansion member associated with each wall panel 16 comprises an elongated track assembly 26 of generally inverted U-shaped configuration mounted over the upper edge 28 of the wall panel 16. The track assembly 26 is defined by an upper bridge plate 32 connected along opposing side margins to a pair of slide plates 34 which extend downwardly to receive and overlap with the wall panel upper edge 28. A pneumatic actuator 36 in the form of an inflatable tube or the like is carried within a chamber 38 between the upper edge 28 of the wall panel 16, and the underside of the bridge plate 32. Inflation of the pneumatic actuator 36 causes the track assembly 26 to advance upwardly toward the raised position with elongated resilient seal strips 40 on the top of the bridge plate 32 contacting the ceiling 30. Conversely, deflation the pneumatic actuator 36 permits the track assembly 26 to retract downwardly to the lowered position, with the seal strips 40 spaced from the ceiling 30. Sliding soft acoustic seal strips 42 or the like may be provided between the wall panel 16 and the inboard surfaces of the slide plates 34 to insure smooth sliding movement and also to enhance the acoustic barrier.

When the turntable 10 is rotatably moved to an alternative floor plan position, the pneumatic actuator 36 of the track assembly 26 is deflated, to allow the seal strips 40 to retract downwardly and away from the ceiling 30. However, when the alternative floor plan position is reached, the pneumatic actuator 36 is inflated, advancing the seal strips 40 to the raised position in contact with the ceiling 30. In the raised position, the track assembly 26 provides an effective acoustic barrier between adjacent rooms disposed on opposite sides of the turntable wall panel 16. The acoustic barrier is enhanced by the use of dual seal strips 40 in spaced-apart parallel relation to define a substantially sealed or dead air space 44 therebetween.

FIGS. 4–10 illustrate one of the turntable doors 18 in one preferred form, including hinged mounting means for hanging the door 18 from a turntable wall panel 16, and related door expansion members for engaging adjacent building structures when the door is in a closed position.

More specifically, each turntable door 18 is suspended by a hinge assembly 46 disposed generally at the turntable periphery, and mounted at the termination edge of one of the turntable wall panels 16. The hinge assembly 46 for each door 18 comprises an upright cylindrical casing 48 attached to the hinged or inboard side edge of the door 18 by means of upper and lower hanger brackets 50 and 52 attached to the door 18 and projecting through a vertically elongated casing slot 54 to the casing interior. The upper hanger bracket 50 carries a drive motor 56 with one or more drive wheels 58 frictionally engaging the interior of a drive sleeve 60 secured by a connector plate 62 to the top of the adjacent wall panel 16 (FIGS. 4 and 5). The lower hanger bracket 52 is fixed to an upstanding spindle 64 (FIG. 6) which projects upwardly from the turntable floor platform 14. The spindle 64 projects through an acoustic seal member or diaphragm 65. An acoustic seal ring 66 (FIG. 5) is carried about the drive sleeve 60 to engage the interior of the hinge casing 48. In addition, seal strips 67 (FIG. 5) may be provided between the door 18 and the edges of the casing slot 54 to provide an acoustic seal for any gap therebetween.

In operation, rotary drive movement of the drive wheels 58, associated with the drive motor 56, causes the casing 48 and associated door 18 to swing through a selected path of arcuate motion, between open and closed positions. The drive motor 56 is reversible, so that back-and-forth motion can be achieved. The direction and magnitude of swinging door movement between the open and closed positions, is dictated by the rotary position of the turntable 10 and the configuration of adjacent building wall 22 associated therewith, and is appropriately controlled by the main control unit 25 (FIG. 1).

FIGS. 7–10 show the expansion member of the turntable door 18, for engaging adjacent building structures to provide the desired acoustic barrier. In the preferred and simplified form, the expansion member comprises a pneumatic actuator 68 in the form of an inflatable tube or the like mounted at an inset position nested within a channel 70 to extend within and along the top, bottom and outboard side edges of the door. The actuator 68 is fitted over a series of pulleys or guide rollers 71 to accommodate at least some longitudinal displacement of the actuator tubing. The opposite ends of the actuator 68 are anchored within the door interior by a pair of tension springs 72 which normally place the actuator under tension. A pneumatic line 74 is provided for selectively connecting and disconnecting the actuator tubing to a source 75 of air under pressure, for selectively inflating and deflating the actuator 68, in response to operation of the control unit 25. Corner brackets 76 (FIGS. 10 and 11) of generally U-shaped cross section are conveniently fitted over the actuator tubing at the corners of the door to provide a snug fit relative to adjacent building structures when the door 18 is closed and the actuator tubing is inflated. A spring 78 is connected between each corner bracket 76 and the adjacent guide roller 71 to retract the corner bracket inwardly when the actuator tubing is deflated. (FIG. 1) which will be described in more detail.

When the pneumatic actuator tubing 68 is deflated, as shown in FIG. 8, a clearance space is normally present between the edges of the door 18 and adjacent building structures. That is, a clearance space is present between the lower edge of the door 18, and the floor surface 20 of the building. Similarly, a clearance space is present between the upper edge of the door 18, and the ceiling 30. A further clearance space is present between the outboard or free edge of the door, and the adjacent edge or jamb of the associated building wall 22. Thus, the turntable 10 can be rotated to alternative floor plan positions, and/or the door can be opened or closed, without interfering with adjacent building structures.

However, when the door is closed, the pneumatic actuator 68 can be inflated to engage the adjacent building structure, as shown in FIG. 9. In this configuration, the previously discussed gaps are eliminated by the expansion of the pneumatic actuator 68, to provide an effective sound barrier between adjacent rooms.

The control unit 25 functions to deflate the pneumatic actuators 36 and 68 associated with the wall panels 16 and doors 18, respectively, whenever the turntable is rotated to an alternative floor plan position. Thereafter, the control unit 25 functions to inflate the pneumatic actuator 36 associated with the wall panels 16, thereby providing a sound barrier between adjacent rooms. The pneumatic actuators 68 associated with the doors 18 are inflated only when the associated doors are closed, but are otherwise deflated during door opening and closing movement. The control unit 25 is programmed to respond to the particular rotational position of the turntable to ensure door swinging movement, in the correct direction and magnitude, to achieve the desired opening and closing movement relative to the adjacent walls 22. In this regard, the hinge assembly 46 accommodates swinging door movement through nearly 360 degrees of rotation, whereby adequate opening and closing swinging movement can be achieved for a range of different wall geometries.

In accordance with one aspect of the invention, each, each hinge assembly 46 includes a safety impact sensor 80 (FIG. 7) which will signal the control unit 25 to interrupt rotary movement of the turntable, in the event that the hinge assembly 46 impacts or bumps against any obstacle during such rotary turntable motion. The impact sensor may also be employed, when the turntable 10 is in a selected floor plan position, to provide for simple door opening and closing. That is, the control unit 25 can be programmed to permit the impact sensor 80 to respond when the turntable is not in motion to open the door 18 in response to rapping or knocking on the door or the casing 48 of the hinge assembly. Similarly, subsequent door closure can be accomplished by rapping or knocking on the door or the hinge assembly casing 48. A similar impact sensor (not shown) can be used with the track assemblies on the wall panels to interrupt turntable rotation in the event that the track assembly bumps an obstacle.

Figure 12:
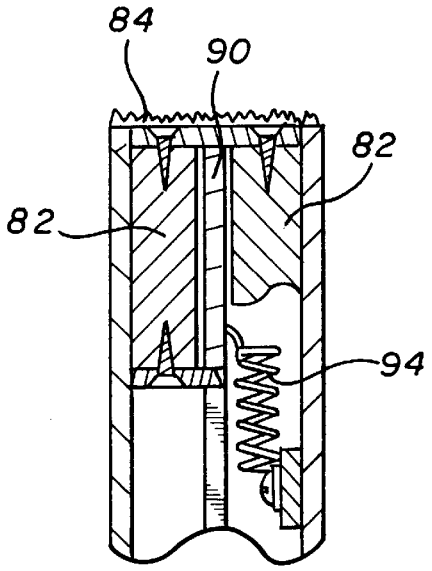
FIG. 12 is an enlarged fragmented sectional view taken generally on the line 12—12 of FIG. 11.

FIGS. 11 and 12 show an alternative configuration for a turntable door 18, wherein components corresponding to those shown and described in FIGS. 1–10 are identified by common reference numerals. As shown, the pneumatic actuator 68 is provided in the form of a length of inflatable tubing or the like, nested in an inset position within a channel 70 in the top, bottom and outboard side edges of the door. The actuator tubing 68 is positioned to bear against a plurality of rigid seal segments 82 disposed respectively at the top, bottom and outboard side edges of the door. These seal strip segments 82, which may include a soft liner 84 on the outer faces thereof, are supported on the door for retraction and advancement by means of elongated slots 86 therein for receiving guide pins 88 mounted on the door. The upper and lower corners of the outboard side edge include L-shaped seal plates 90 carried in guide slots 92 (FIG. 12) formed in the adjacent ends of the seal strips 82, wherein the outwardly advanced seal strips 82 carry the seal plates 90 outwardly to fill the corners of the doorway space, when the actuator tubing is inflated. However, when the actuator tubing is deflated, springs 94 connected between the seal plates 90 and the door 18 effectively, pull the seal plates 90 and the seal strips 82 back to their retracted positions.

FIG. 13 illustrates a further modified door geometry, wherein components corresponding to those shown and described in FIGS. 1–12 are again identified by common reference numerals. In this configuration, a plurality of seal strips 82 are nested in a channel 70 at the top, bottom and outboard side edges of the door, wherein these seal strips 82 are again adapted for advancement and retraction relative to surrounding stationary building structures and further include the L-shaped seal plates 90 at the upper and lower corners of the outboard side edge. The seal strips 82 are biased normally outwardly to the advanced positions by springs 96 reacting between the door frame 98 and the seal strips. A plurality of cables 100 are attached to the seal strips 82 and are reeved over appropriate pulley 102 for connection to a control wheel 104 adapted for rotation on an axis 106 to pull the seal strips 82 to the retracted positions.

An actuator 108 such as a piston-cylinder ram device is coupled to the air line 74 and functions to rotate the control wheel 104 in a direction retracting the seals strips 82 when air pressure is supplied thereto. Conversely, when air pressure is relieved from the actuator, the springs 96 return the seal strips 82 to the advanced positions, with a corresponding part-circle rotation of the control wheel.

A variety of further modifications and improvements to the rotary turntable of the present invention will be apparent to those skilled in the art. Accordingly, no limitation on the invention is intended by way of the foregoing description and accompanying drawings, except as set forth in the appended claims.

What is claimed is:

1. A turntable for installation into a building, comprising:

a rotary platform movable relative to the building to a selected one of a plurality of different rotational positions corresponding to different floor plans;

at least one wall panel mounted on said platform, said wall panel defining a variable floor plan according to the selected rotational position of said platform; and at least one expansion member mounted on said wall panel and movable between an advanced position for engaging an adjacent stationary building structure to provide an acoustic barrier between opposite sides of said wall panel, and a retracted position in spaced relation to the adjacent stationary building structure to permit interference free platform rotation.

2. The turntable of claim 1 further including means for moving said expansion member between said advanced and retracted positions.

3. The turntable of claim 2 wherein said expansion member moving means comprises a pneumatic actuator.

4. The turntable of claim 1 wherein said expansion member comprises a track assembly movably mounted on an upper edge of said wall panel, and actuator means for raising and lowering said track assembly relative to said wall panel respectively between said advanced and retracted positions.

5. The turntable of claim 4 wherein said actuator means comprises an actuator tube interposed between said wall panel and said track assembly.

6. The turntable of claim 4 wherein said track assembly has a generally inverted U-shaped cross section received over the upper edge of said wall panel.

7. The turntable of claim 4 wherein the stationary building structure comprises a ceiling, and further wherein said track assembly includes a resilient seal strip for engaging the ceiling.

8. The turntable of claim 7 wherein said track assembly includes a pair of resilient seal strips mounted in spaced and generally parallel relation for engaging the ceiling and for defining an air space therebetween.

9. The turntable of claim 1 further including at least one door hingedly mounted on said wall panel for movement between open and closed positions relative to the stationary building structure.

10. The turntable of claim 9 further including at least one expansion member mounted on said door and movable between an advanced position for engaging the adjacent stationary building structure to provide an acoustic barrier between opposite sides of the door when said door is in the closed position, and a retracted position in spaced relation to the adjacent stationary building structure to permit interference free door movement between the open and closed positions and further to permit interference free platform rotation.

11. The turntable of claim 10 including means for opening the door when the platform is rotated.

12. The turntable of claim 10 wherein said door has an inboard hinged edge, a top edge, a bottom edge, and an outboard edge, said at least one expansion member mounted on said door extending along said top, bottom and outboard edges.

13. The turntable of claim 10 further including a pneumatic actuator for moving said at least one expansion member on said door between the advanced and retracted positions.

14. The turntable of claim 13 wherein said pneumatic actuator comprises an inflatable actuator tube.

15. The turntable of claim 9 including hinge means for swingably mounting said door on said wall panel, and drive means for power drive movement of said door between the open and closed positions.

16. The turntable of claim 15 wherein said door has an inboard edge, a top edge, a bottom edge, and an outboard edge, and said hinge means comprises a generally cylindrical casing mounted along the inboard edge of said door, and support means on said wall panel for rotatably supporting said casing.

17. The turntable of claim 16 wherein said casing is positioned generally at the periphery of said platform.

18. The turntable of claim 15 wherein said drive means comprises a reversible drive motor mounted on one of said door and said wall panel, and a drive sleeve mounted on the other of said door and said wall panel, said drive motor including a drive element engaging said drive sleeve to move said door between the open and closed positions.

19. The turntable of claim 18 wherein said drive motor is mounted on said door and wherein said drive sleeve is mounted on said wall panel.

20. The turntable of claim 15 further including impact sensor means for interrupting rotation of said platform in response to impact of said door with an object.

21. The turntable of claim 15 further including impact sensor means for opening and closing said door in response to manual knocking mounted on one of said door and said hinge means to move said door between the open and closed positions when said platform is in a selected one of said rotational positions.

22. A turntable for installation into a building, comprising:

a rotary platform movable relative to the building to a selected one of a plurality of different rotational positions corresponding to different floor plans;

at least one wall panel and at least one door mounted on said platform and defining a variable floor plan according to the selected rotational position of said platform; and at least one expansion member mounted on said wall panel and at least one expansion member mounted on said door, said expansion members being movable between an advanced position for engaging adjacent stationary structures of the building to provide an acoustic barrier between adjacent rooms on opposite sides of said wall panel and said door, and a retracted position in spaced relation to the adjacent stationary building structures to permit interference free platform rotation and further to permit interference free movement of said door between open and closed positions.

23. The turntable of claim 22 further including control means for moving said expansion members on said wall panel and said door to said retracted positions during rotary platform movement, and further for moving said at least one expansion member on said door to said retracted position when said door is opened.

24. The turntable of claim 22 further including pneumatic actuators for moving said expansion members between said advanced and retracted positions.

25. The turntable of claim 24 wherein each of said pneumatic actuators includes an inflatable actuator tube.

26. The turntable of claim 22 wherein said at least one expansion member mounted on said wall panel comprises a track assembly movably mounted on an upper edge of said wall panel, and actuator means for raising and lowering said track assembly relative to said wall panel respectively between said advanced and retracted positions.

27. The turntable of claim 26 wherein said track assembly has a generally inverted U-shaped cross section received over the upper edge of said wall panel.

28. The turntable of claim 26 wherein one of the stationary building structures comprises a ceiling and further wherein said track assembly includes a resilient seal strip for engaging the ceiling.

29. The turntable of claim 28 wherein said track assembly includes a pair of resilient seal strips mounted in spaced and generally parallel relation for engaging the ceiling and for defining an air space therebetween.

30. The turntable of claim 22 wherein said door has an inboard hinged edge, a top edge, a bottom edge, and an outboard edge, said at least one expansion member mounted on said door extending along said top, bottom and outboard edges.

31. The turntable of claim 22 including hinge means for swingably mounting said door on said wall panel, and drive means for power drive movement of said door between the open and closed positions.

32. The turntable of claim 31 wherein said door has an inboard hinged edge, a top edge, a bottom edge, and an outboard edge, and said hinge means comprises a generally cylindrical casing mounted along said inboard hinged edge of said door, and support means on said wall panel for rotatably supporting said casing.

33. The turntable of claim 32 wherein said casing is positioned generally at the periphery of said platform.

34. The turntable of claim 31 wherein said drive means comprises a reversible drive motor mounted on one of said door and said wall panel, and a drive sleeve mounted on the other of said door and said wall panel, said drive motor including a drive element engaging said drive sleeve to move said door between the open and closed positions.

35. The turntable of claim 31 further including impact sensor means for interrupting rotation of said platform in response to impact of said door with an object.

36. The turntable of claim 31 further including impact sensor means for opening and closing said door in response to manual knocking mounted on one of said door and said hinge means to move said door between the open and closed positions when said platform is in a selected one of said rotational positions.

* * * * *